US008787815B2

(12) United States Patent
Maeda

(10) Patent No.: US 8,787,815 B2
(45) Date of Patent: Jul. 22, 2014

(54) SHEET CONVEYING APPARATUS AND IMAGE FORMING APPARATUS

(75) Inventor: Naoyuki Maeda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 117 days.

(21) Appl. No.: 13/442,245

(22) Filed: Apr. 9, 2012

(65) Prior Publication Data

US 2012/0269558 A1 Oct. 25, 2012

(30) Foreign Application Priority Data

Apr. 22, 2011 (JP) ..... 2011-095657

(51) Int. Cl.
*G03G 15/00* (2006.01)
*B65H 9/00* (2006.01)

(52) U.S. Cl.
CPC ..... *B65H 9/004* (2013.01)
USPC ..... 399/395; 399/388

(58) Field of Classification Search
CPC ..... B65H 9/004
USPC ..... 399/395
See application file for complete search history.

(56) References Cited

U.S. PATENT DOCUMENTS

| | | | | |
|---|---|---|---|---|
| 5,642,652 | A * | 7/1997 | Inoue et al. | 91/376 R |
| 5,642,952 | A * | 7/1997 | Tomatsu et al. | 400/624 |
| 6,011,948 | A | 1/2000 | Amano et al. | |
| 6,712,355 | B2 * | 3/2004 | Nakaoda et al. | 271/236 |
| 7,584,960 | B2 * | 9/2009 | Ha | 271/246 |
| 7,681,882 | B2 * | 3/2010 | Yu et al. | 271/243 |
| 8,317,192 | B2 * | 11/2012 | Karikusa et al. | 271/243 |
| 8,478,182 | B2 * | 7/2013 | Yang | 399/395 |
| 8,554,124 | B2 * | 10/2013 | Lee et al. | 399/391 |

FOREIGN PATENT DOCUMENTS

| | | |
|---|---|---|
| JP | S62-130942 | 6/1987 |
| JP | H09-183539 | 7/1997 |
| JP | 2007-106572 | 4/2007 |
| JP | 2009-220897 | 10/2009 |

* cited by examiner

*Primary Examiner* — Anthony Nguyen
(74) *Attorney, Agent, or Firm* — Fitzpatrick, Cella, Harper & Scinto

(57) ABSTRACT

A sheet conveying apparatus includes: a shutter member against which a leading edge of a sheet being conveyed abuts, for a skew feed correction, wherein the shutter member is pressed and moved by the sheet; and an actuation member which moves the shutter member that has been pressed and moved by the sheet being conveyed to a retracted position at which the shutter member is retracted from a sheet conveying path and holds the shutter member at the retracted position until the leading edge of the sheet being conveyed by the second conveying rotary member is nipped by the transfer nip portion.

12 Claims, 18 Drawing Sheets

SHEET CONVEYING APPARATUS AND IMAGE FORMING APPARATUS

BACKGROUND OF THE INVENTION

1. Field of the Invention

The present invention relates to a sheet conveying apparatus including a mechanism which corrects a skew feed of a sheet, and an image forming apparatus including the same.

2. Description of the Related Art

In general, for an image forming apparatus, an image recording position with respect to a sheet position is an important factor of image quality. Therefore, for a conventional image forming apparatus, various kinds of mechanisms to be mounted thereon for correcting a skew feed of a sheet are proposed in order to improve their recording accuracy.

For example, there is known a sheet conveying apparatus which is provided with, on an upstream side (hereinafter, referred to as "upstream side") in a sheet conveying direction which is closest to an image forming portion, a registration roller pair extending in a width direction perpendicular to the sheet conveying direction, and a shutter member (Japanese Patent Application Laid-Open No. H09-183539). The sheet conveying apparatus adopts a registration shutter method in which a skew feed of a sheet is corrected by bringing the leading edge of the sheet into abutment against the shutter member. The above-mentioned shutter member is configured to be swingable about the rotational axis of the registration roller pair into a posture allowing latching of a leading edge of a sheet through abutment against the leading edge of the sheet, and into a posture allowing a sheet to pass therethrough. The shutter member is urged by an elastic member, such as a spring, in a direction for restoring the shutter member, after a sheet has passed the shutter member, from the posture allowing a sheet to pass the shutter member to the posture allowing latching of a leading edge of a sheet.

That is, in the sheet conveying apparatus, on a rotational shaft of a conveying rotatable member of the registration roller pair, the shutter members are pivotably disposed at predetermined intervals along the axial direction of the rotational shaft so that a leading edge of a sheet, which is conveyed by a conveying roller pair on an upstream side, is brought into abutment against abutment surfaces of the shutter members. Then, a loop is gradually formed on the sheet so as to increase a force for pressing the shutter members by the leading edge of the sheet. Therefore, the shutter members are pressed to be pivoted and retracted to allow the sheet to pass through the shutter members. When the leading edge of the sheet is pressed against the shutter members to pivot the shutter members, the leading edge of the sheet is oriented along the abutment surfaces of the shutter members so that the leading edge of the sheet is aligned with a direction perpendicular to the sheet conveying direction. In this state, the registration roller pair conveys the sheet. Thus, the skew feed of the sheet is corrected during the conveyance of the sheet.

However, in the conventional sheet conveying apparatus described above, when a sheet is conveyed through the registration roller pair, the shutter members are urged by an elastic member such as a spring for restoring the shutter members to the posture allowing latching of the leading edge of the sheet, and hence the shutter members are pressed against the surface of the sheet which is being conveyed by the registration roller pair. As a result, for an extremely thin sheet having a basis weight of less than 60 g/m$^2$, or a sheet having a low stiffness, such sheet is brought into a corrugated state due to the pressing force of the shutter members which are disposed in the axial direction at predetermined intervals.

Accordingly, when the sheet in the corrugated state is nipped by a transfer roller portion (transfer portion) of the image forming portion on a downstream side, the sheet of paper may be crinkled.

SUMMARY OF THE INVENTION

The present invention provides a sheet conveying apparatus and an image forming apparatus, which correct a skew feed of a sheet without crinkling a sheet. According to an exemplary embodiment of the present invention, there is provided a sheet conveying apparatus, including; a first conveying rotary member which conveys a sheet; a second conveying rotary member and a third conveying rotary member which are sequentially disposed downstream of the first conveying rotary member in a sheet conveying direction; a shutter member against which a leading edge of the sheet being conveyed abuts downstream of the first conveying rotary member and upstream of a nip portion of the second conveying rotary member, wherein the shutter member is pressed and moved by the sheet being conveyed; and an actuation member which moves the shutter member that has been pressed and moved by the sheet being conveyed to a retracted position at which the shutter member is retracted from a sheet conveying path and holds the shutter member at the retracted position until the leading edge of the sheet being conveyed by the second conveying rotary member is nipped by the third conveying rotary member.

According to the present invention, a crinkling of a sheet can be decreased.

Further features of the present invention will become apparent from the following description of exemplary embodiments with reference to the attached drawings.

DESCRIPTION OF THE EMBODIMENTS

Figure 1:
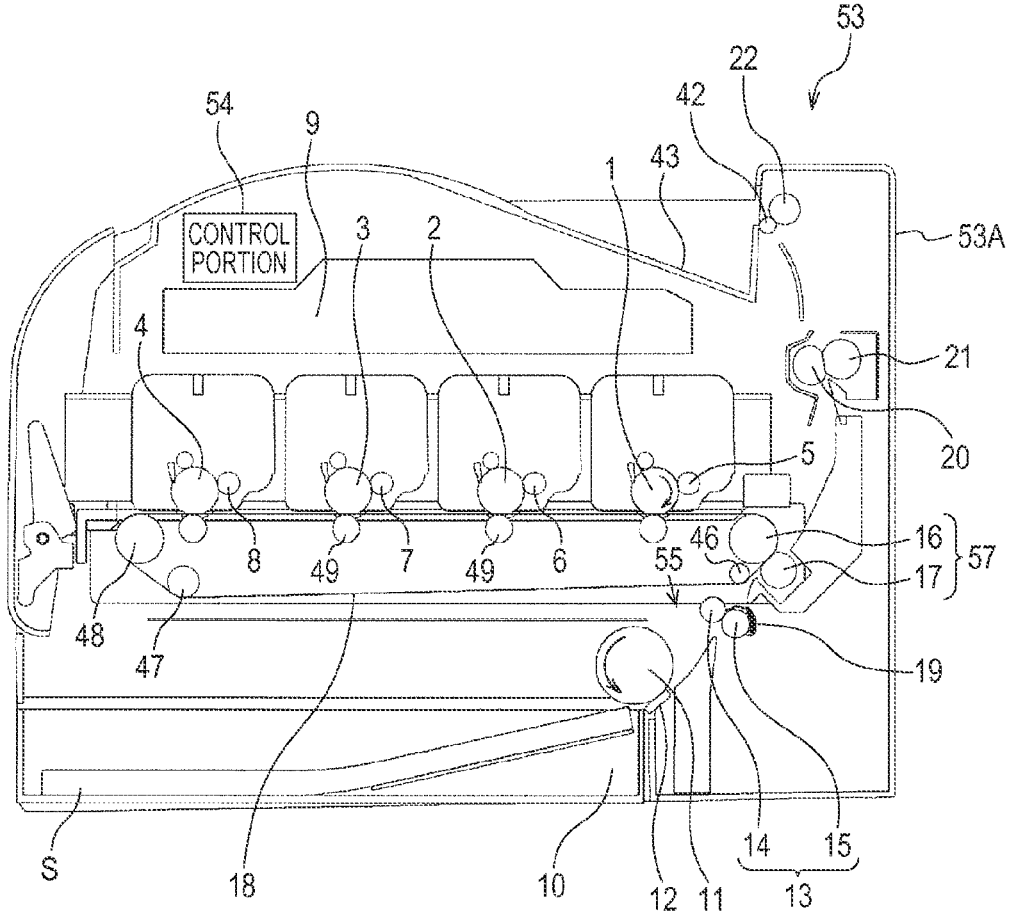
FIG. 1 is a cross-sectional view illustrating an image forming apparatus according to an embodiment of the present invention.
Figure 2:
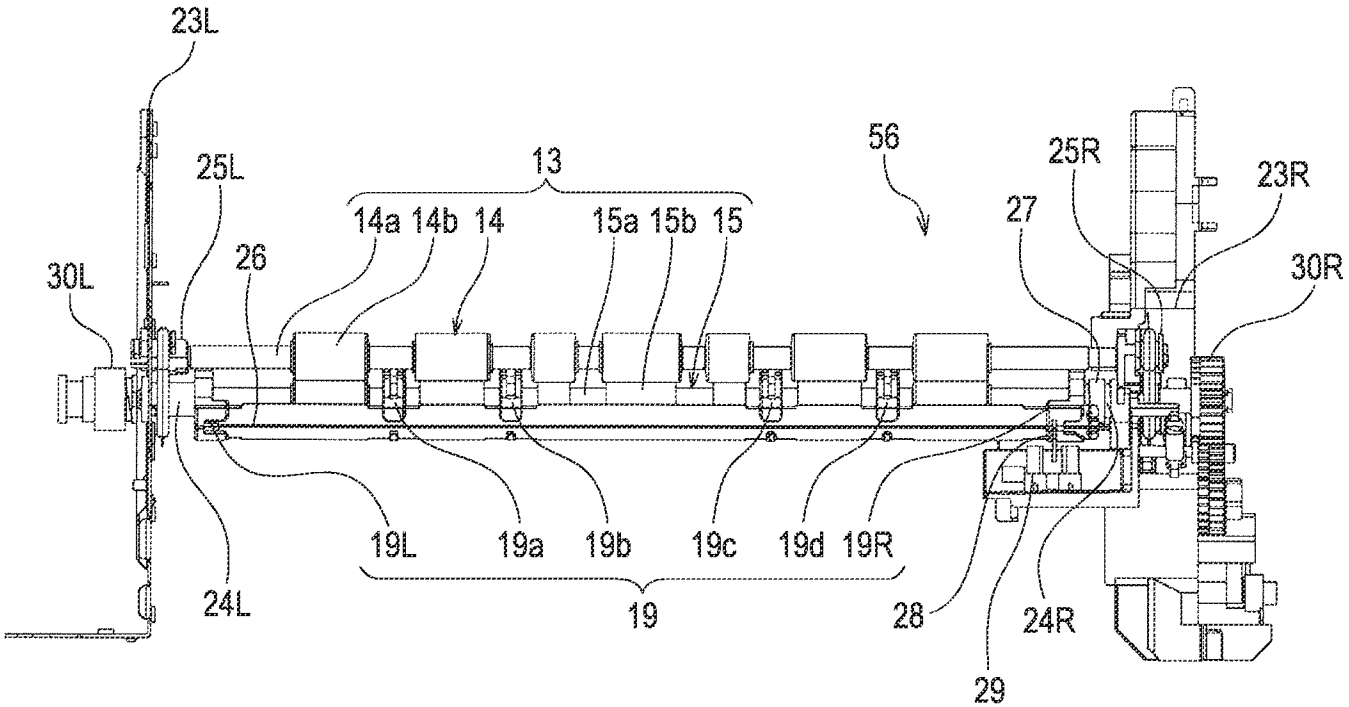
FIG. 2 is a plan view illustrating a shutter retracting mechanism.
Figure 3:
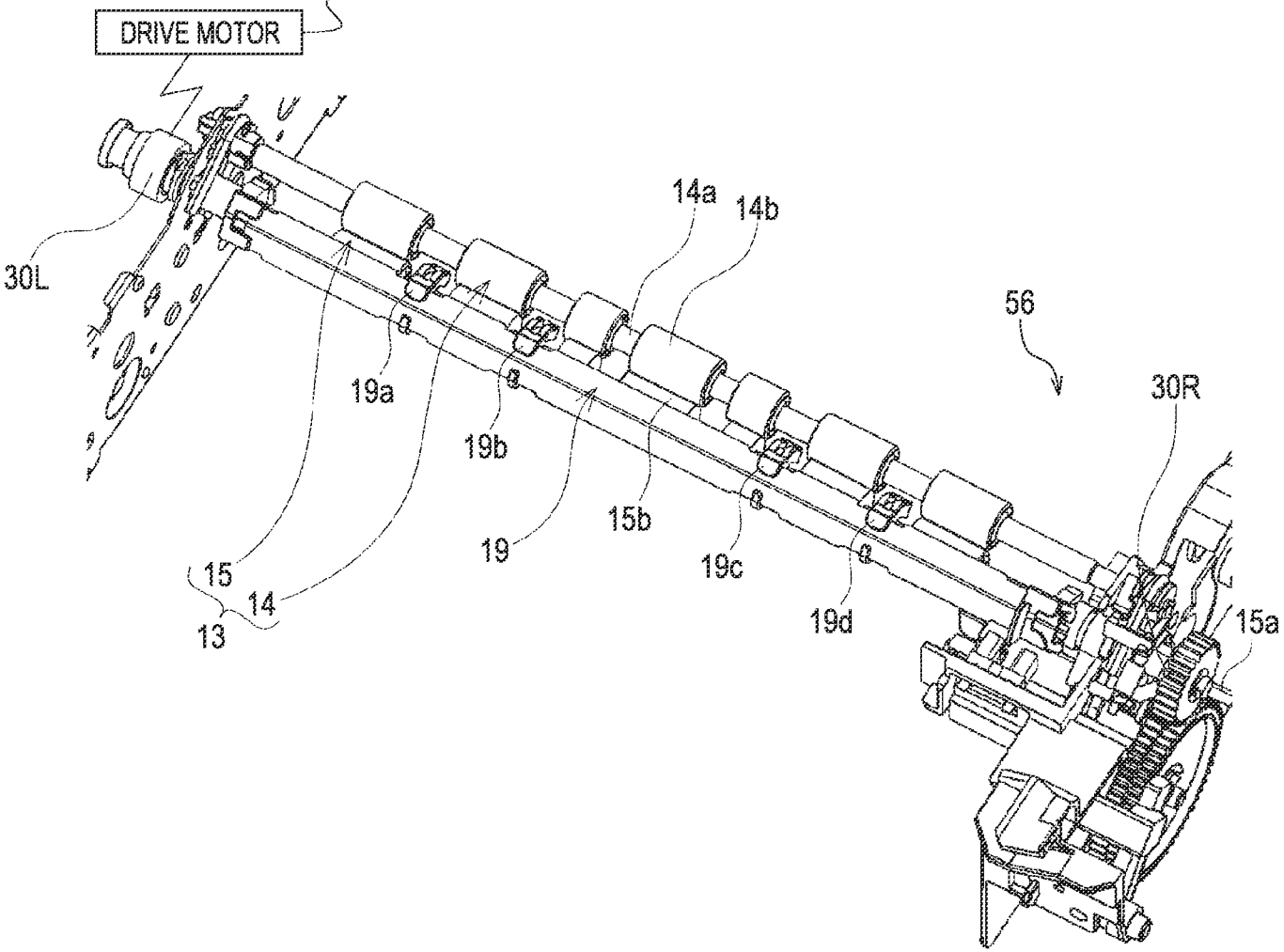
FIG. 3 is a schematic perspective view illustrating the shutter retracting mechanism.

An embodiment according to the present invention will be described in detail with reference to the drawings. FIG. 1 is a schematic cross-sectional view illustrating an entire laser beam printer 53, which serves as an image forming apparatus, including a sheet conveying apparatus 55 according to a first embodiment of the present invention. FIG. 2 is a plan view illustrating a shutter retracting mechanism 56 of the embodiment, and FIG. 3 is a schematic perspective view illustrating the shutter retracting mechanism 56 of the embodiment.

First, referring to FIG. 1, an entire configuration and functions of the laser beam printer 53 of the embodiment will be described. The laser beam printer includes a control portion 54 which overall controls respective portions. Sheets S contained in a feed tray 10, which is mounted on the lower part of a printer main body 53A of the laser beam printer 53, are fed out by a feed roller (first conveying rotary member) 11 rotating in the counter-clockwise direction in FIG. 1, and are separated by a separation pad 12 sheet by sheet so as to be fed. The sheet S, which has been fed by the feed roller 11, is conveyed by a conveying roller pair (second conveying rotary member) 13 formed of a conveying rotatable member 14 and a conveying roller 15, and is conveyed to a nip portion of a transfer portion (third conveying rotary member) 57 formed of a transfer opposing roller 16 and a transfer roller 17. The conveying roller pair 13 and the transfer portion 57 are disposed downstream of the feed roller 11 in the sheet conveying direction in this order. The transfer portion 57 also constitutes an image forming portion which forms an image on the sheet S. The sheet conveying apparatus 55 includes the feed roller 11, the conveying roller pair 13, the transfer opposing roller 16, and the transfer roller 17.

Photosensitive drums 1, 2, 3, and 4 respectively rotate in the clockwise direction in FIG. 1. Electrostatic latent images are sequentially formed on respective outer circumferential surfaces of the photosensitive drums 1, 2, 3, and 4 by laser beams from a laser scanner 9. Subsequently, the electrostatic latent images are respectively developed by development rollers 5, 6, 7, and 8 so that toner images are formed.

The respective toner images formed on the photosensitive drums 1 to 4 are transferred to an intermediate transfer belt 18 which rotates in the counter-clockwise direction in FIG. 1. When a color image is to be formed, respective colors of yellow, magenta, cyan, and black are developed on the photosensitive drums 1 to 4. Then, the toner images respectively formed thereon are transferred to the intermediate transfer belt 18. Next, the toner images formed on the intermediate transfer belt 18 are transferred to the sheet S which has been conveyed to the nip portion between the transfer opposing roller 16 and the transfer roller 17.

Moreover, the sheet S, on which the toner image has been transferred, is conveyed to a nip portion of a fixing portion formed of a fixing film 20 and a pressure roller 21, and is heated and pressurized in the nip portion so that the toner image is fixed on the sheet S. The sheet S, on which the toner image has been fixed, is delivered to a sheet delivery tray 43 by a delivery roller 22 and a delivery rotatable member 42. The laser beam printer 53 further includes tension rollers 46, 47, a drive roller 48, and primary transfer rollers 49.

As illustrated in FIG. 2, the conveying roller 15 of the conveying roller pair 13 is rotatably supported by bearings 24L, 24R which are respectively provided on feed frames 23L, 23R. The feed frames 23L, 23R are supported by the printer main body 53A on both sides in the width direction (the right-left direction in FIG. 2) perpendicular to the sheet conveying direction. The conveying rotatable member 14 of the conveying roller pair 13 is rotatably supported by bearings 25L, 25R which are respectively provided on the feed frames 23L, 23R. The bearings 25L, 25R are supported by the printer main body 53A on both sides in the width direction perpendicular to the sheet conveying direction.

The conveying roller 15 and the conveying rotatable member 14 respectively include a roller main body 15*b* and a roller main body 14*b* which are divided into a plurality of portions in the width direction perpendicular to the sheet conveying direction so as to have a positional relationship in which the divided portions of the roller main body 15*b* are opposed to the divided portions of the roller main body 14*b*, respectively. The conveying roller 15 includes a rotational shaft 15*a* and the roller main body 15*b* which is fixed to the rotational shaft 15*a* so as to rotate integrally with the rotational shaft 15*a*. The conveying rotatable member 14 includes a rotational shaft 14*a* and the roller main body 14*b* which is rotatably supported on the rotational shaft 14*a* so as to individually rotate.

A shutter connection member 19 is disposed at the position of the conveying roller pair 13. The shutter connection member 19 includes shutter members 19*a*, 19*b*, 19*c*, and 19*d*, and a connection member 26. The shutter members 19*a* to 19*d* include abutment surfaces disposed in gaps of the conveying roller pair 13 which are divided into the plurality of portions. The connection member 26 is supported by bearing portions 19L, 19R disposed at both ends thereof, and connects the shutter members 19*a* to 19*d* in the longitudinal direction. The shutter members 19*a* to 19*d* perform, at a position which is downstream of the feed roller 11 and upstream of the nip portion of the conveying roller pair 13, such operations that a sheet S, which is being conveyed, abuts against the shutter members 19*a* to 19*d* at initial positions to correct a skew feed of the sheet S, and is fed into the nip portion of the conveying roller pair 13. The shutter members 19*a* to 19*d* positioned at the initial positions assume postures allowing latching of the leading edge of sheet which is being conveyed. The shutter members 19*a* to 19*d* are supported so that, after performing a skew feed correction when pressed by the leading edge of the sheet S which is being conveyed by the feed roller 11, the shutter members can pivot toward retracted positions at which the abutment surfaces of the shutter members are retracted from the conveying path.

Specifically, the shutter connection member 19 is disposed so as to be pivotable about the conveying roller 15 by fitting the bearings 19L, 19R provided at both ends of the shutter connection member 19 into the bearings 24L, 24R supporting the conveying roller 15, respectively. The bearings 24L, 24R are respectively supported on the feed frames 23L, 23R on both sides of the bearings 24L, 24R in the width direction perpendicular to the sheet conveying direction.

Moreover, a torsion coil spring 27 serving as an urging member which urges the shutter members 19*a*, 19*b*, 19*c*, and 19*d* toward the initial positions, is slidably fitted into the bearing 19R. The torsion coil spring 27 urges the entire shutter connection member 19 in a direction opposite to the sheet conveying direction in a state in which one end thereof is latched with an opening portion (not shown) provided at the right end of the connection member 26 in FIG. 2, and in which the other end thereof is latched with the feed frame 23R. A sensor flag 28 which detects the presence or absence of the sheet S is fixed on the bearing portion 19R. The sensor flag 28 has a shape of projecting in a direction perpendicular to the longitudinal direction of the shutter connection member 19. A photo-interrupter which detects the sensor flag 28 is disposed at a position opposed to the sensor flag 28.

As illustrated in FIG. 3, gears 30L, 30R are provided at both ends of the conveying roller 15, respectively, so as to rotate integrally with the conveying roller 15. The gear 30L is configured to transmit a drive force from a drive motor 301 serving as a drive source to the conveying roller 15, and the gear 30R constitutes a gear which transmits the drive force to a mechanism which operates the shutter connection member 19 described next.

Figure 4A:
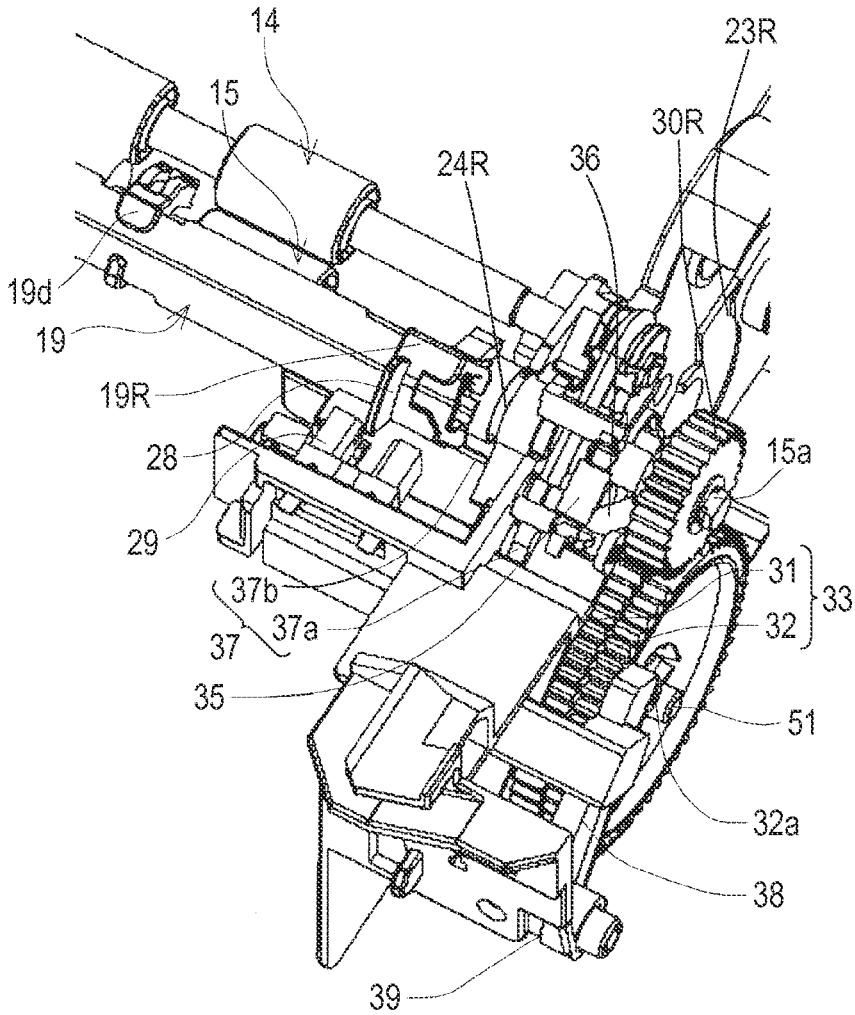
FIGS. 4A and 4B are enlarged views of FIG. 3 illustrating the shutter retracting mechanism.
Figure 4B:
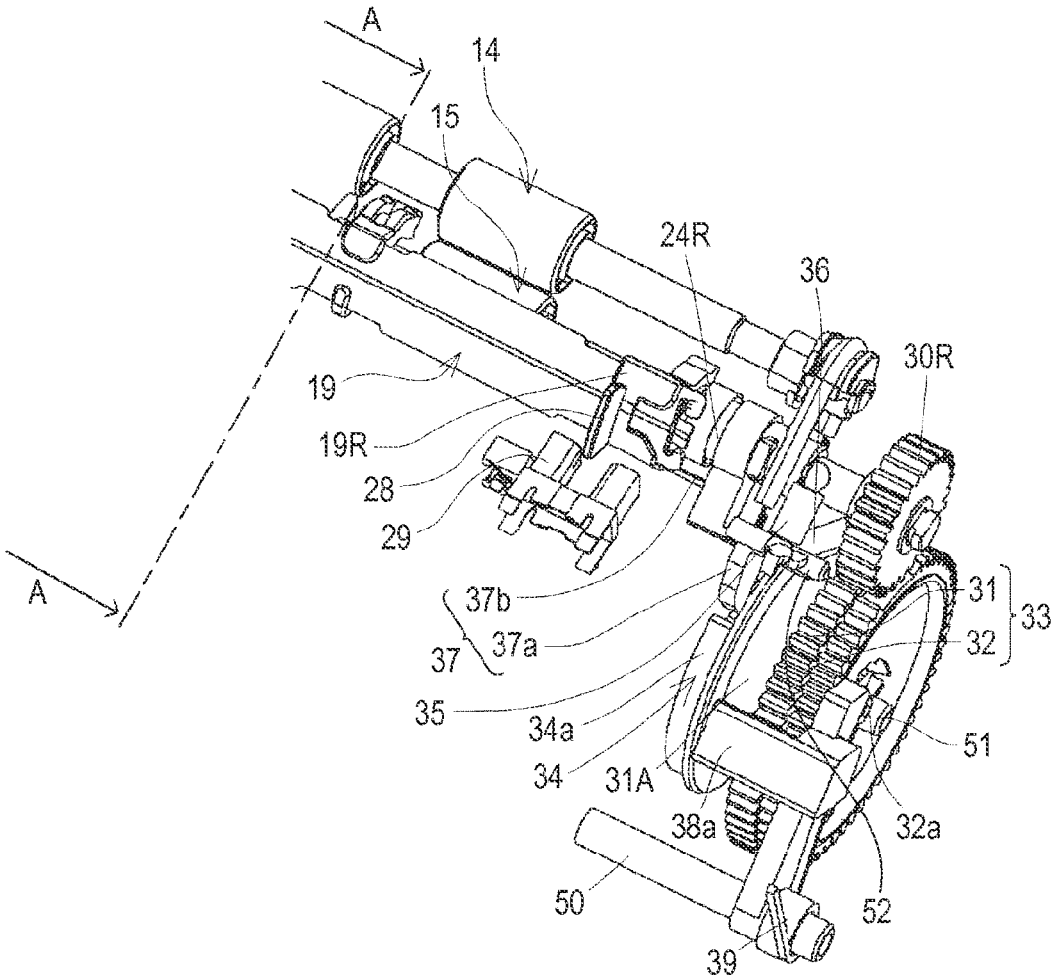
Figure 6:
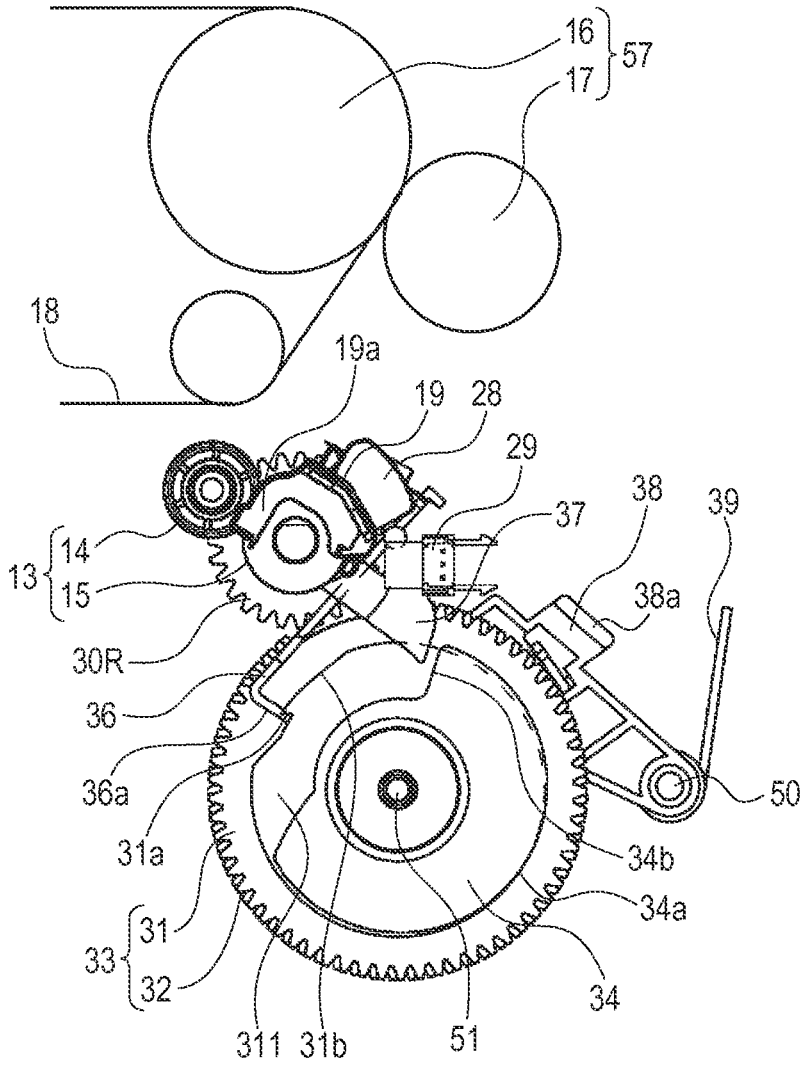
FIG. 6 is a cross-sectional view illustrating a state of the shutter retracting mechanism cut along the A-A line of FIG. 4B and viewed in the direction of the arrows of FIG. 4B.

FIGS. 4A and 4B are enlarged perspective views of the shutter retracting mechanism 56 of the embodiment illustrated in FIG. 3. FIG. 4B is a view in which the feed frame 23R is omitted from FIG. 4A. FIG. 6 is a cross-sectional view illustrating a state of the shutter retracting mechanism 56 of the embodiment cut along the A-A line of FIG. 4B and viewed in the direction of the arrows of FIG. 4B. FIGS. 10A to 10D are side views illustrating a series of motions of a first partially-toothless gear 31, and FIGS. 11A to 11D are side views illustrating a series of motions of a second partially-toothless gear 32 and an actuation cam 34 serving as an actuation member. FIGS. 12A to 12D are side views illustrating a series of motions of the second partially-toothless gear 32 and an urging lever 38. Note that, FIGS. 12A to 12D illustrate the states viewed from the side opposite to FIGS. 10A to 10D and FIGS. 11A to 11D. In the embodiment, the first partially-toothless gear 31 and the second partially-toothless gear 32 constitute a transmission gear which transmits the drive force from the gear 30R to the actuation cam 34.

As illustrated in FIGS. 4A and 4B, at the connecting position of the gear 30R, there is provided a double partially-toothless gear 33 formed of the first partially-toothless gear 31 and the second partially-toothless gear 32 which have the same diameters and are coaxially connected to each other. Both the first partially-toothless gear 31 and the second partially-toothless gear 32 are configured to mesh with the gear 30R.

The first partially-toothless gear 31 includes a toothless portion 31*c* which is formed by removing a part of a tooth portion 31*d* formed on the circumference of the first partially-toothless gear 31. The second partially-toothless gear 32 is formed so as to have the same diameter as that of the first partially-toothless gear 31 and overlap with the first partially-toothless gear 31 in the axial direction. The second partially-toothless gear 32 includes a toothless portion 32*b* which is formed by removing a part of a tooth portion 32*c* formed on the circumference of the second partially-toothless gear 32. The toothless portions 31*c*, 32*b* are formed so as to have the same length in the circumferential direction.

The first partially-toothless gear 31 is disposed so as to be rotatable about a rotational shaft 51 of the second partially-toothless gear 32. The first partially-toothless gear 31 rotates by an angle which is determined with respect to the second partially-toothless gear 32, and then rotates integrally with the second partially-toothless gear 32 by an abutment portion (not shown) disposed inside the first partially-toothless gear 31. The first partially-toothless gear 31 is urged by a spring (not shown) disposed between the second partially-toothless gear and the first partially-toothless gear 31 so as to rotate in the counter-clockwise direction in FIGS. 6 to 9B.

As illustrated in FIGS. 4A, 4B, 10A, 10B, 10C, and 10D, the first partially-toothless gear 31 integrally includes on its side surface a latching cam 311 which is positioned between the actuation cam 34 coaxially supported by the rotational shaft 51 and the first partially-toothless gear 31. The latching cam 311 includes on its outer circumference an outer circumferential cam face 31*b* and a claw portion 31*a*, and is coaxially connected to the first partially-toothless gear 31. That is, the latching cam 311 has a substantially circular shape as a whole, is formed into a cam shape so as to include on its outer circumference the outer circumferential cam face 31*b* forming the most part of the circumference of the latching cam 311 and the claw portion 31*a* formed on a part of the circumference thereof, and is coaxially connected to the first partially-toothless gear 31.

The actuation cam 34 constitutes a cam member which is rotatable in one direction and coaxially connected to the second partially-toothless gear 32. The cam member includes on its outer circumference a circumferential cam face (retention cam face) 34*a* and a recess portion (permissible cam face) 34*b*. The recess portion (permissible cam face) 34*b* allows the actuation cam (actuation member) 34 to pivot when the shutter members 19*a* to 19*d* pivot from the initial positions to the retracted positions. The circumferential cam face (retention cam face) 34*a* abuts against the back surface of an actuation lever 37 to retain the actuation lever 37 when the shutter members 19*a* to 19*d* are located at the retracted positions. The actuation cam 34 is disposed coaxially with the first partially-toothless gear 31, the latching cam 311, and the second partially-toothless gear 32. Moreover, the actuation cam 34 is formed into a substantially circular shape, and includes the above-mentioned circumferential cam face 34*a* and the above-mentioned recess portion 34*b* which is formed as a cutout portion so as to have a diameter smaller than that of the circumferential cam face 34*a*.

Figure 5A:
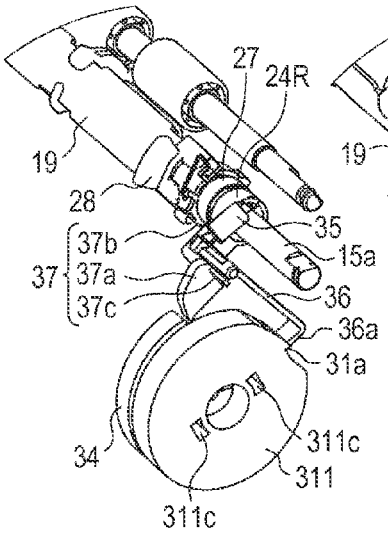
FIGS. 5A, 5B, 5C, 5D, and 5E are perspective views illustrating the shutter retracting mechanism.
Figure 5B:
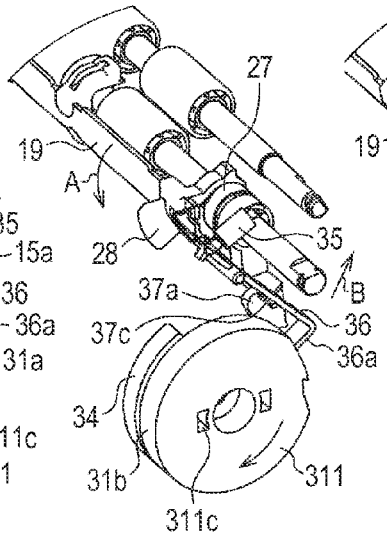
Figure 5C:
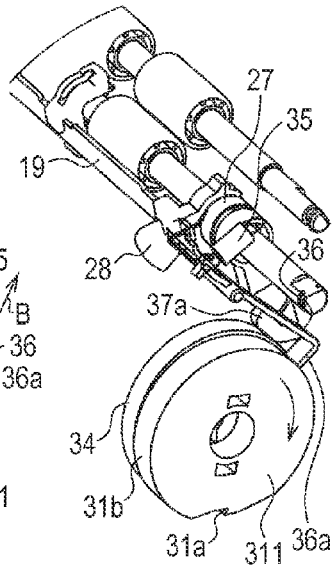
Figure 5D:
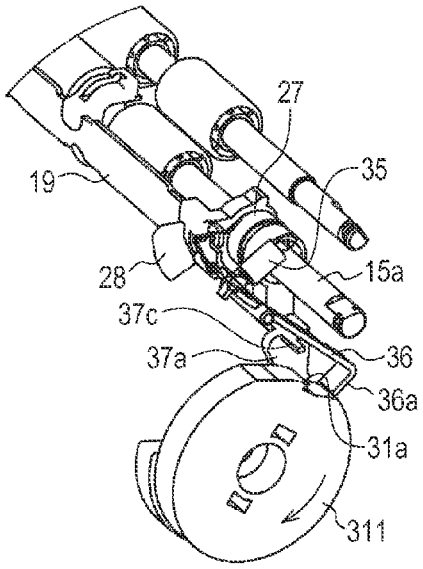
Figure 5E:
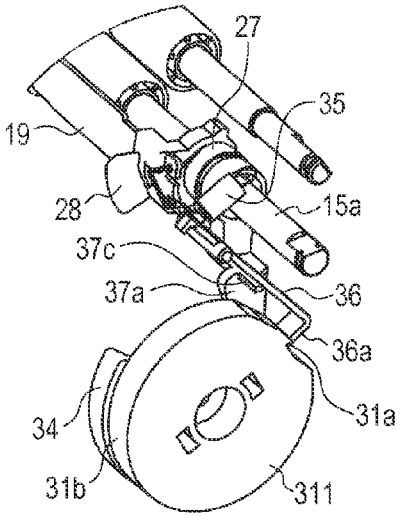

The second partially-toothless gear 32 is connected by a key groove (not shown) to the actuation cam 34 which actuates the position of the shutter connection member 19 (also refer to FIGS. 11A to 11D) so as to sandwich the first partially-toothless gear 31 and the latching cam 311 between the second partially-toothless gear 32 and the actuation cam 34. An opening portion 311*c*, through which a key is inserted, is formed as illustrated in FIG. 5A. The second partially-toothless gear 32 integrally includes on the outer edge portion of the outer surface (side surface thereof) a rib 32*a* having a substantially circular arc shape (also refer to FIGS. 12A to 12D). An urging lever 38 is provided so as to be pivotable about a shaft 50 which is supported on the printer main body 53A, and includes an opposing surface 38*b* opposed to the rib 32*a* when the double partially-toothless gear 33 is located at its initial stop position.

As illustrated in FIGS. 4A, 4B, and 12A to 12D, the urging lever 38 is urged by a torsion coil spring 39 toward the double partially-toothless gear 33. The torsion coil spring 39 has one end thereof which engages with the printer main body 53A side, and the other end thereof which engages with an upper engagement portion 38*a* of the urging lever 38, so as to apply an urging force to the urging lever 38. As illustrated in FIGS. 4A and 4B, there are provided a tension coil spring 35, and the actuation lever serving as an actuation member (an abutment portion against the actuation cam 34) which pivots substantially integrally with the shutter members 19*a* to 19*d*. A shutter portion is formed by the shutter connection member 19 and the actuation lever 37.

FIGS. 5A to 5E and 13A to 13E are perspective views illustrating the shutter retracting mechanism 56 of the embodiment. The shutter retracting mechanism 56 retains the shutter members 19*a* to 19*d* at the retracted positions at which the shutter members 19*a* to 19*d* are retracted from the conveying path of the sheet S until the sheet S, which has been subjected to a skew feed correction and is being conveyed by the conveying roller pair 13, is nipped at its leading edge by the nip portion of the transfer portion 57. Moreover, when the leading edge of the sheet S is nipped by the nip portion of the transfer portion 57, the shutter retracting mechanism 56 releases the retention of the shutter members 19*a* to 19*d* at the retracted positions so that the shutter members 19*a* to 19*d* become restorable toward the initial positions.

Specifically, as illustrated in FIGS. 5A to 5E and 13A to 13E, at a position opposed to the outer circumferential cam face 31*b* of the first partially-toothless gear 31, there is provided a rotatable latching arm (latching member) 36 having an L-letter shape which is urged by the tension coil spring 35 against the outer circumferential cam face 31*b*. The latching arm 36 has a distal end provided with a hook portion 36*a* which engages and disengages from the claw portion 31*a* of the latching cam 311. The proximal end of an elongated portion of the latching arm 36 is supported by a shaft 52 so as to be rotatable toward the rotational shaft 15*a*. Accordingly, the hook portion 36*a* is disposed so as to be slidable on (brought into slidable contact with) the outer circumferential cam face 31*b* of the latching cam 311. Moreover, as illustrated in FIGS. 13A to 13E, an opening portion 361 is formed in the central portion of the latching arm 36.

As illustrated in FIGS. 4A and 4B, the actuation lever 37 is disposed at a position opposed to the circumferential cam face 34*a* of the actuation cam 34. The actuation lever 37 is configured to be fitted into the bearing 24R supporting the conveying roller 15 and be rotatable about the conveying roller 15. As illustrated in FIGS. 4A, 4B, and 5A to 5E, the actuation lever 37 includes a lever portion 37*a*, a boss portion 37*b* parallel to the conveying roller 15, and an abutment portion 37*c*.

As illustrated in FIGS. 4A, 4B, and 6, the lever portion 37*a* slides on (is brought into slidable contact with) on the circumferential cam face 34*a* of the actuation cam 34. As illustrated in FIGS. 13A to 13E and 5A to 5E, the boss portion 37*b* engages with the bearing portion 19R of the shutter connection member 19 so that the shutter connection member 19 is connected to the actuation lever 37 so as to be integrally pivoted therewith. As illustrated in FIGS. 13A to 13E and 5A to 5E, when the shutter connection member 19 pivots in the direction of the arrow A, the abutment portion 37*c* abuts against the lower surface of the L-letter shaped latching arm 36 so as to press the latching arm 36 upward in the direction of the arrow B against the urging force of the tension coil spring 35. After that, when the actuation lever 37 abuts against the cam face 34*a* of the actuation cam 34 and rotates, the abutment portion 37*c* of the actuation lever 37 moves upward through the opening portion 361 of the latching arm 36 so that the latching arm 36 and the actuation lever 37 are released from being pressed upward.

After that, when the abutment between the actuation lever 37 and the cam face 34*a* of the actuation cam 34 is released, the actuation lever 37 rotates in a direction opposite to the direction of the arrow A so as to move below the latching arm 36 by an engagement play with respect to the shutter connection member 19.

Next, the retracting mechanism of the shutter connection member 19 will be described with reference to FIGS. 6 to 12D. FIGS. 6 to 8, 9A, and 9B are cross-sectional views taken along the A-A line of FIG. 4B and viewed in the direction of the arrows of FIG. 4B. For the sake of illustration, among the shutter members 19*a* to 19*d* which are disposed in the longitudinal direction of the shutter connection member 19, only the shutter member 19*a* is illustrated in FIGS. 6 to 9B.

FIGS. 6, 10A, 11A and 12A illustrate the initial positions.

The hook portion 36*a* of the L-letter shaped latching arm 36 latches the claw portion 31*a* of the latching cam 311 which is integral with the first partially-toothless gear 31. Then, the opposing surface 38*b* of the urging lever 38 urges the rib 32*a* of the second partially-toothless gear 32 (refer to FIG. 12A) so that the double partially-toothless gear 33 and the actuation cam 34 are stopped at the initial positions illustrated in FIG. 12A. In this state, the toothless portion 31*c* of the first partially-toothless gear 31 and the toothless portion 32*b* of the second partially-toothless gear 32 are axially overlapped with each other at the same position in the circumferential direction.

The shutter connection member 19 and the actuation lever 37, which rotate in a substantially integral state (refer to FIGS. 4A, 4B, and 5A to 5E), are urged by the torsion coil spring 27 so as to be latched at the initial positions at which the shutter members 19*a* to 19*d* can abut against the leading edge of the sheet S to latch the sheet leading edge. In this state, the lever portion 37*a* of the actuation lever 37 is located at the position of the recess portion 34*b* at which the lever portion 37*a* does not abut against the actuation cam 34. In addition, the sensor flag 28, which can pivot integrally with the shutter connection member 19, is set in a positional relationship in which the optical path of the photo-interrupter 29 is allowed to transmit therethrough.

Figure 7:
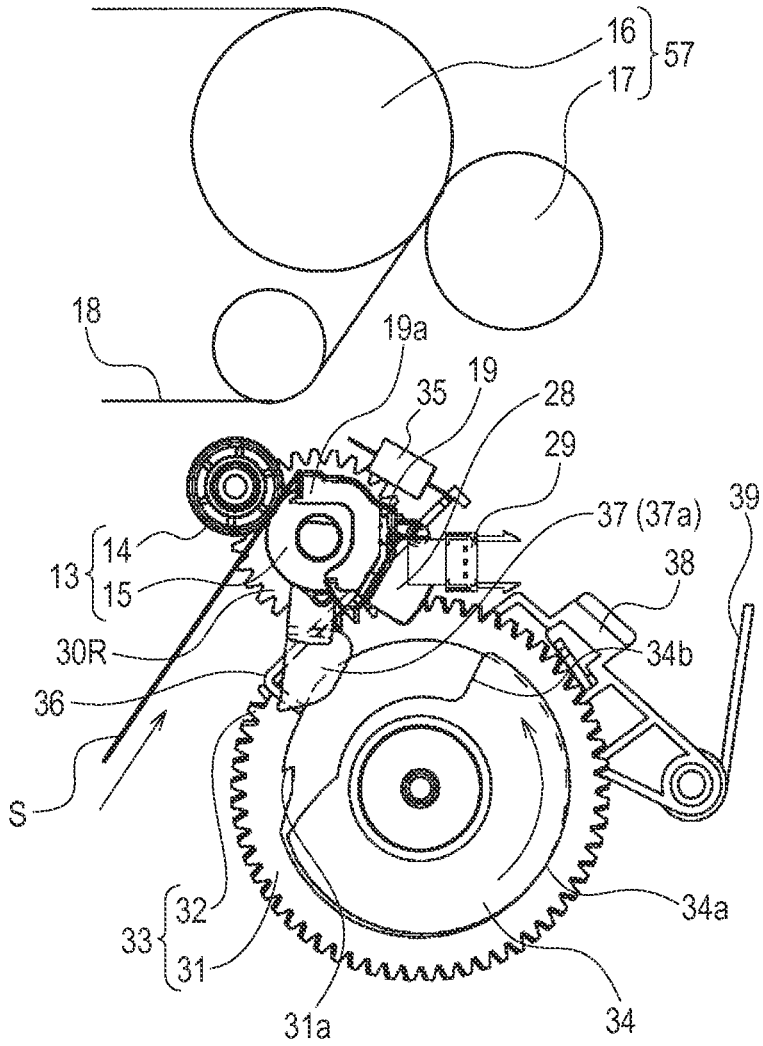
FIG. 7 is a cross-sectional view illustrating another state of the shutter retracting mechanism cut along the A-A line of FIG. 4B and viewed in the direction of the arrows of FIG. 4B.

Next, the leading edge of the sheet S, which has been conveyed by the feed roller 11, abuts against the shutter members 19*a* to 19*d*. Then, when the sheet leading edge becomes parallel to the axial direction of the conveying roller pair 13, the force generated by the stiffness of the sheet S overcomes the urging pressure (urging force) of the torsion coil spring 27 so as to press the shutter connection member 19 to be opened. Accordingly, as illustrated in FIG. 7, the sheet S is corrected about its posture so as to pass through the nip of the conveying roller pair 13. That is, in a period in which the leading edge of the sheet S is pressing the shutter members 19*a* to 19*d* to pivot the shutter members 19*a* to 19*d*, the leading edge of the sheet S is nipped by the conveying roller pair 13.

Figure 10A:
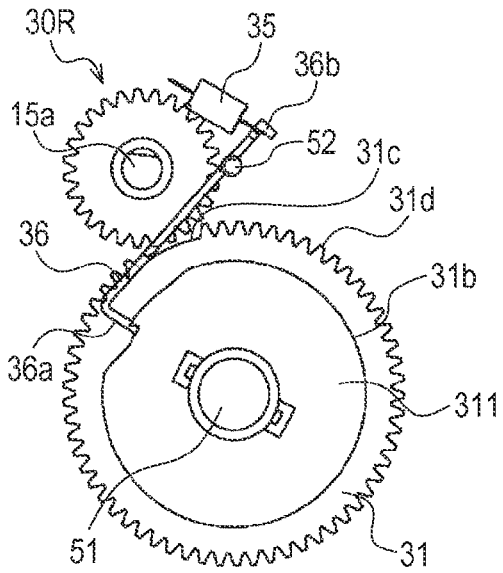
FIGS. 10A, 10B, 10C, and 10D are side views illustrating a series of motions of a first partially-toothless gear.
Figure 10B:
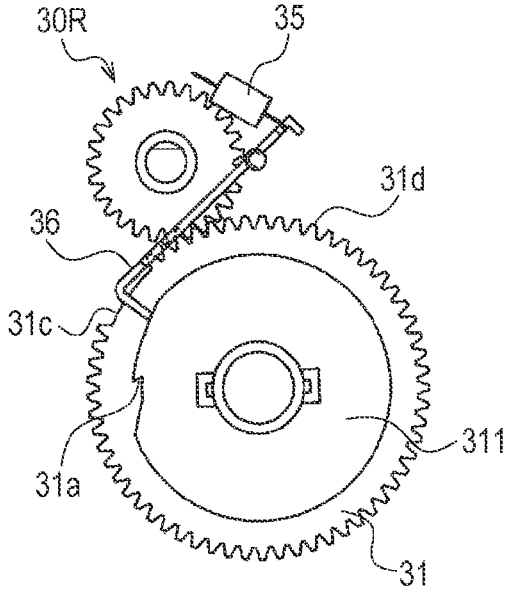
Figure 10C:
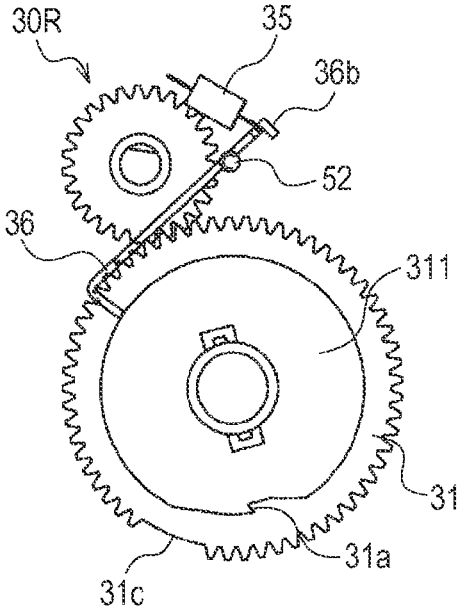
Figure 10D:
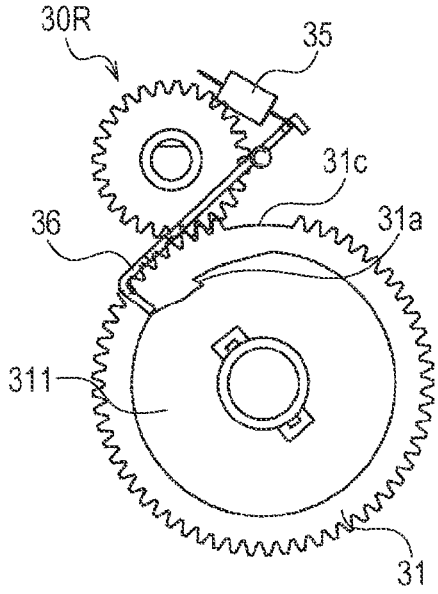

The actuation lever 37 pivots in the clock-wise direction in FIG. 7 so as to press upward the latching arm 36 by the abutment portion 37*c* (refer to FIG. 5B), thereby releasing the latching between the claw portion 31*a* integral with the first partially-toothless gear 31 and the hook portion 36*a* (refer to FIG. 10B). The first partially-toothless gear 31 is rotated by the urging force of the spring (not shown) disposed between the second partially-toothless gear 32 and the first partially-toothless gear 31 in the counter-clockwise direction in FIGS. 7 and 10B so that the toothless portion 31*c* passes through the gear 30R. As a result, the tooth portion 31*d* meshes with the gear 30R so that the drive force from the drive source (not shown) is transmitted. At this time, the sensor flag 28 pivots by the same angle as that of the shutter connection member 19 so as to block the optical path between a light emitting portion and a light receiving portion of the photo-interrupter 29. Accordingly, based on the information, the control portion 54 starts a series of image forming operations.

Figure 8:
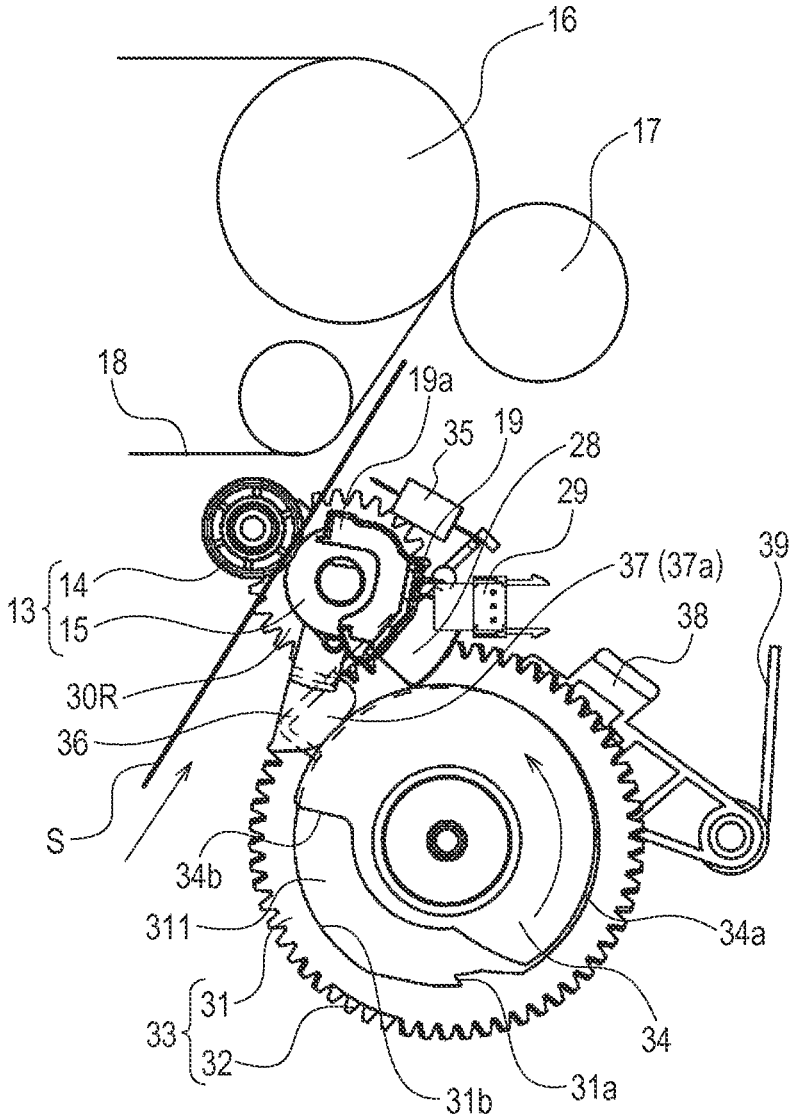
FIG. 8 is a cross-sectional view illustrating still another state of the shutter retracting mechanism cut along the A-A line of FIG. 4B and viewed in the direction of the arrows of FIG. 4B.

Next, as illustrated in FIG. 8, the second partially-toothless gear 32 rotates integrally with (along with) the first partially-toothless gear 31 in the same direction by an abutment portion (not shown) disposed inside the second partially-toothless gear 32, so that the toothless portion 32*b* passes through the gear 30R. Therefore, the tooth portion 32*c* of the second partially-toothless gear 32 meshes with the gear 30R, and the drive force is transmitted thereto so as to start rotating (refer to FIG. 11B). Accordingly, the rib 32*a* moves away from the opposing surface 38*b* of the urging lever 38 (refer to FIG. 12B). At this time, as described above, the actuation cam 34 is connected to the second partially-toothless gear 32 by the key groove (not shown), and hence the actuation cam starts rotating simultaneously with the second partially-toothless gear 32.

After that, the lever portion 37*a* of the actuation lever 37 abuts against the circumferential cam face 34*a* of the actuation cam 34 so as to further rotate in the clockwise direction in FIG. 8 so that the shutter members 19*a* to 19*d* of the shutter connection member 19 are retracted from the conveying path of the sheet S. The actuation lever 37 further moves the shutter members 19*a* to 19*d* that has been pressed and moved by the sheet being conveyed to the retracted position. The actuation lever 37 holds the shutter members 19*a* to 19*d* at the retracted position. That is, the shutter members 19*a* to 19*d* are retained at the retracted positions at which the shutter members 19*a* to 19*d* are retracted from the conveying path of the sheet S, after a skew feed correction has been performed, until the sheet S, which is conveyed by the feed roller 11 and the conveying roller pair 13, is nipped by the transfer nip portion 57 (16, 17). The sheet S is nipped by the transfer nip portion 57 (16, 17) in a state in which the shutter members 19*a* to 19*d* are located at the retracted positions at which the shutter members 19*a* to 19*d* are retracted from the conveying path of the sheet S.

Figure 9A:
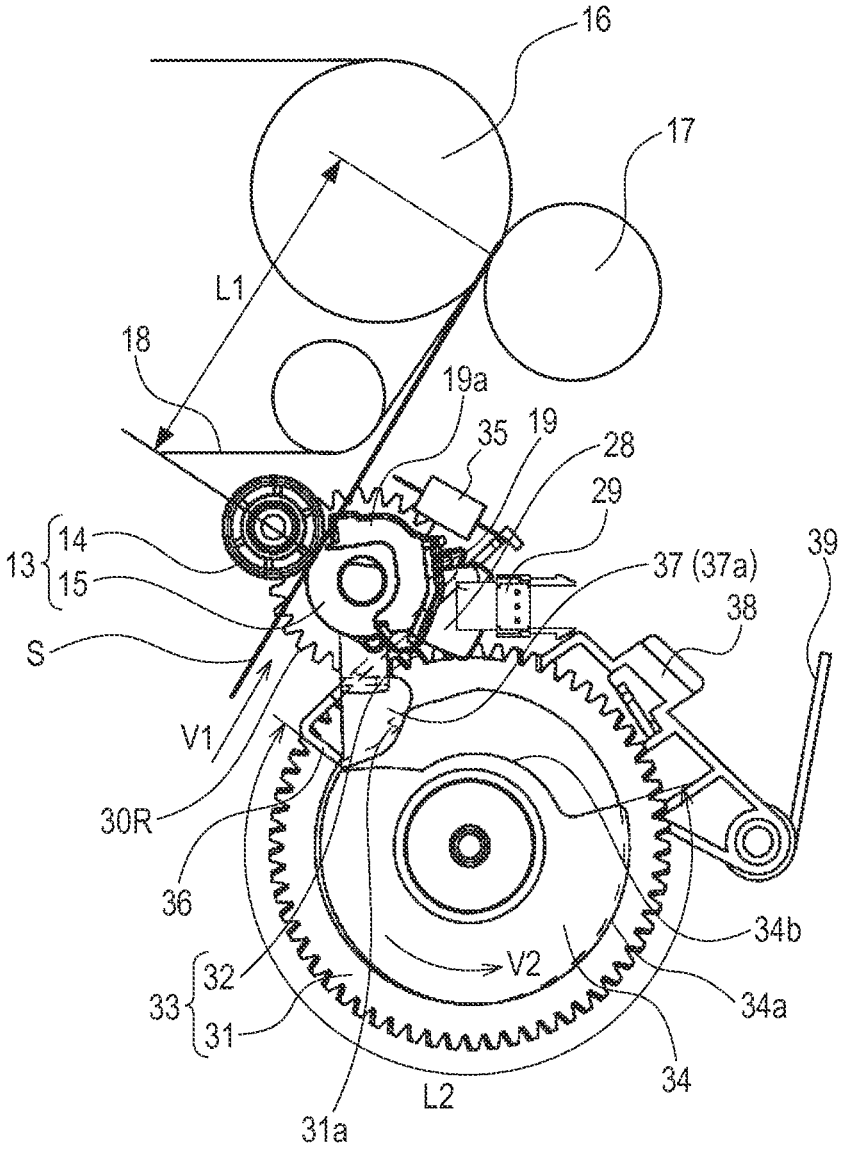
FIGS. 9A and 9B are cross-sectional views illustrating yet another state of the shutter retracting mechanism cut along the A-A line of FIG. 4B and viewed in the direction of the arrows of FIG. 4B.

When the actuation cam 34 rotates so as to release the abutment between the lever portion 37*a* of the actuation lever 37 and the circumferential cam face 34*a* of the actuation cam 34, the actuation lever 37 rotates counter-clockwise (refer to FIG. 9A). At this time, the abutment portion 37*c* of the actuation lever 37 passes through the opening portion 361 of the latching arm 36 so that the latching arm 36 is positioned above the abutment portion 37*c* of the actuation lever 37, thereby releasing the latching arm 36 from being pressed upward by the lever portion 37*a* of the actuation lever 37. Accordingly, the latching arm 36 is urged against the outer circumferential cam face 31*b* on the first partially-toothless gear 31 side by the urging force of the tension coil spring 35. The shutter connection member 19 and the actuation lever 37, which are substantially integrally rotated by the spring force of the torsion coil spring 27, are urged in a direction in which the shutter members 19*a* to 19*d* are pressed toward the surface of the sheet to be conveyed.

Note that, in the embodiment, the state in which the shutter members 19*a* to 19*d* are out of contact with the passing sheet S is defined as the retracted position, but the retracted position is not limited thereto. That is, the retracted position may be defined as a state in which the shutter members 19*a* to 19*d* are retracted to such a degree that the sheet S does not suffer damage such as corrugation at the downstream transfer portion (third conveying rotary member) 57, while the shutter members 19*a* to 19*d* are brought into slight contact with the sheet S, but the load on the sheet S can be reduced.

In FIG. 9A, a length L2 of the circumferential cam face 34*a* of the cam 34 and a rotational speed V2 of the circumferential cam face 34*a* of the cam 34 are set in a relationship which satisfies the following expression (1):

$$L1/V1 \approx L2/V2 \quad (1)$$

where L1 represents a distance between the nip portion of the conveying roller pair 13 and the nip portion of the transfer portion 57 including the transfer opposing roller and the transfer roller 17, and V1 represents a conveying speed of the sheet.

Accordingly, when the sheet S is nipped by the nip portion of the transfer portion 57 and started to be conveyed, because the relationship satisfying the above-mentioned expression (1) is set, the lever portion 37*a* of the actuation lever 37 is positioned at the recess portion 34*b* of the actuation cam 34. With this, the abutment (slidable contact) between the actuation lever 37 and the actuation cam 34 is released. Therefore, the actuation lever 37 and the shutter members 19*a* to 19*d* are restored to the positions at which those members abut against the sheet S due to the urging pressure of the torsion coil spring 27, but, at this point of time, the sheet S has already been nipped by the nip portion of the transfer portion 57 in proper condition. Therefore, even if the sheet S is in a state in which the shutter members 19*a* to 19*d* are slightly brought into slidable contact with the sheet S, the sheet S is conveyed while being smoothly transferred by the transfer portion 57 with no corrugation being generated.

When the actuation lever 37 moves below the latching arm 36 by an engagement play between the boss portion 37*b* of the actuation lever 37 and the shutter connection member 19 (refer to FIGS. 9A and 5D), after that, the hook portion 36*a* engages again with the claw portion 31*a* of the latching cam 311 so that the hook portion 36*a* latches the latching cam 311 (refer to FIGS. 9B, 10A, 11D and 12D). At this time, the toothless portion 31*c* of the first partially-toothless gear 31 reaches the position of meshing with the gear 30R, and the first partially-toothless gear 31 is stopped because the drive force from the drive source is shut off (refer to FIG. 10A).

Figure 11A:
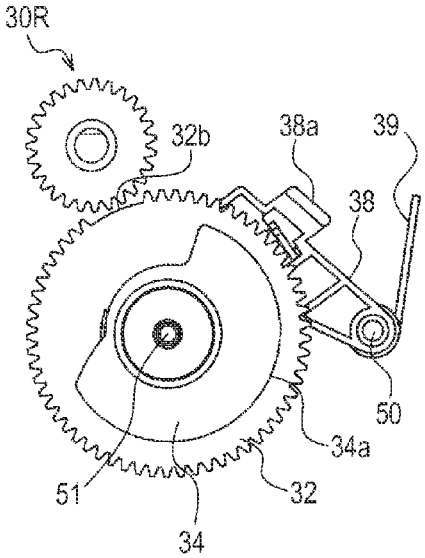
FIGS. 11A, 11B, 11C, and 11D are side views illustrating a series of motions of a second partially-toothless gear and an actuation cam.
Figure 11B:
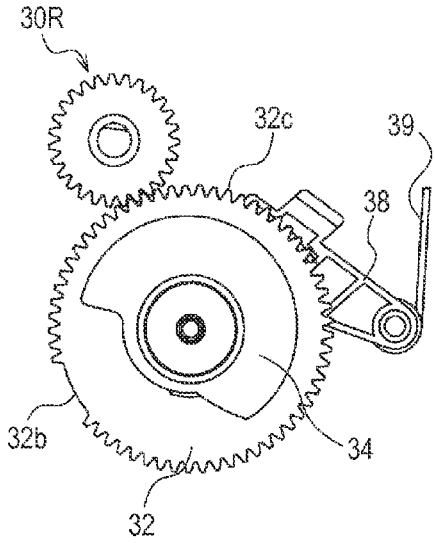
Figure 11C:
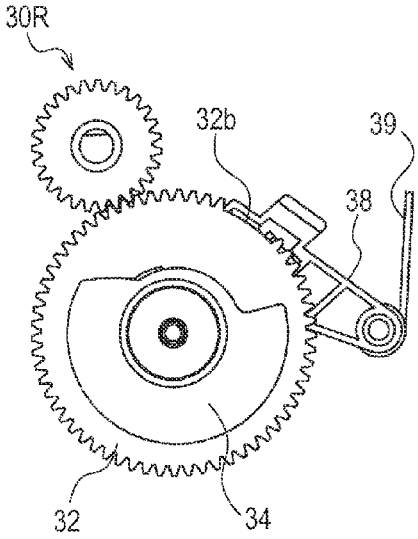
Figure 11D:
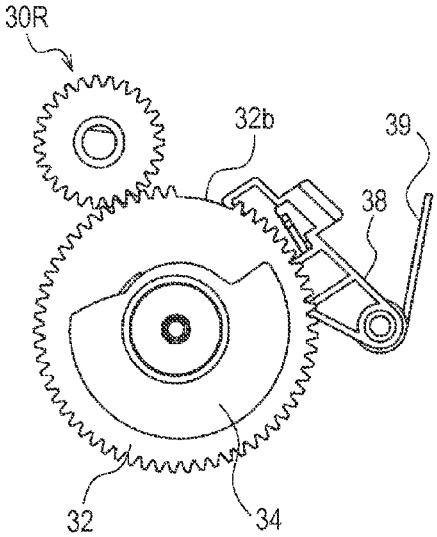
Figure 12A:
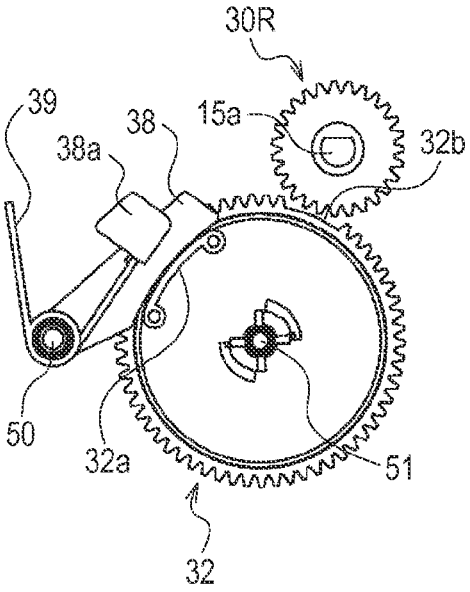
FIGS. 12A, 12B, 12C, and 12D are side views illustrating a series of motions of the second partially-toothless gear and an urging lever.
Figure 12B:
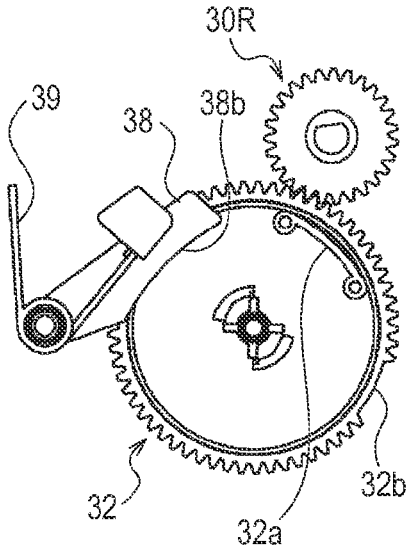
Figure 12C:
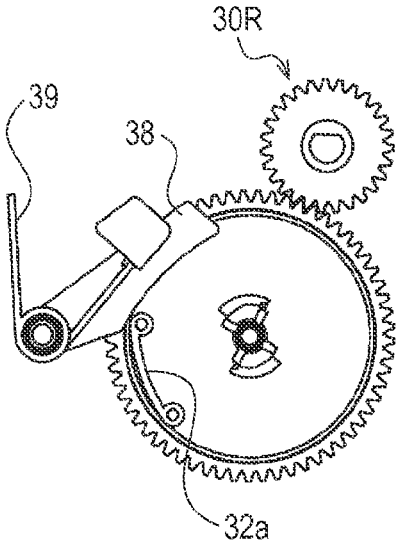
Figure 12D:
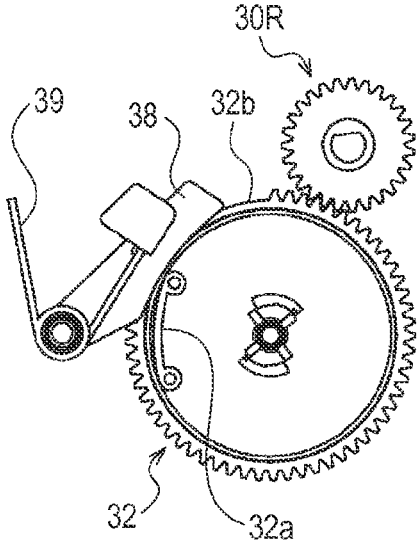
Figure 13A:
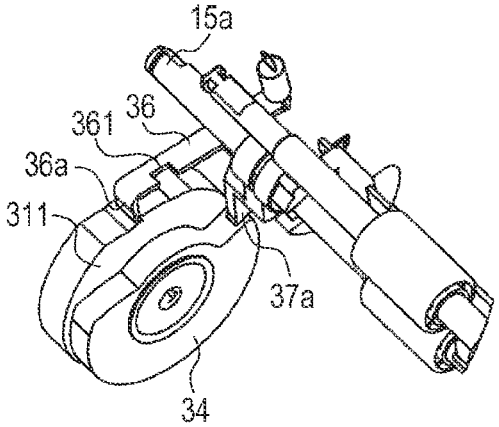
FIGS. 13A, 13B, 13C, 13D, and 13E are perspective views illustrating a series of motions of the actuation cam, a latching arm, and an actuation lever.
Figure 13B:
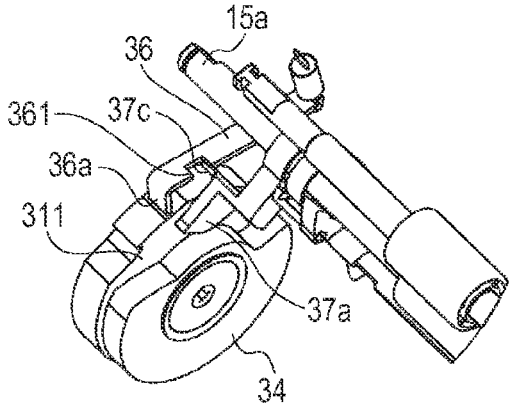
Figure 13C:
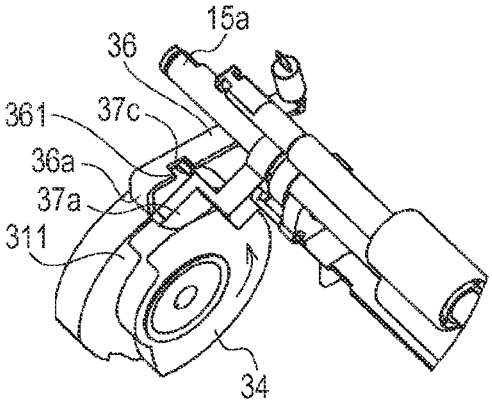
Figure 13D:
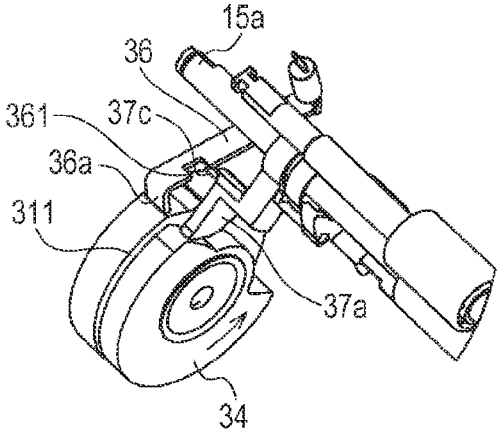
Figure 13E:
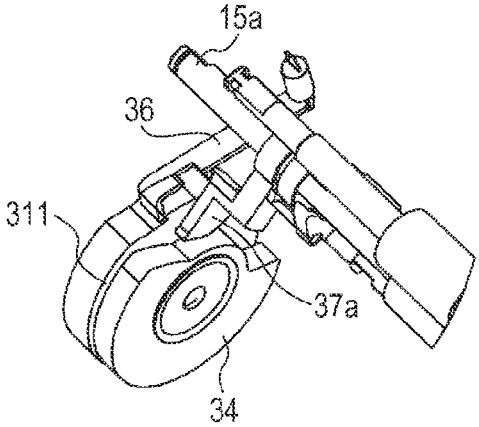

After that, as illustrated in FIGS. 12D and 12A, the toothless portion 32*b* of the second partially-toothless gear 32 reaches the position of meshing with the gear 30R when the rib 32*a* is urged by the opposing surface 38*b* of the urging lever 38, and the second partially-toothless gear 32 is stopped because the drive force from the drive source is shut off (FIG. 11A). With this, the double partially-toothless gear 33 including the first partially-toothless gear 31 and the second partially-toothless gear 32 is located at the initial position.

Figure 9B:
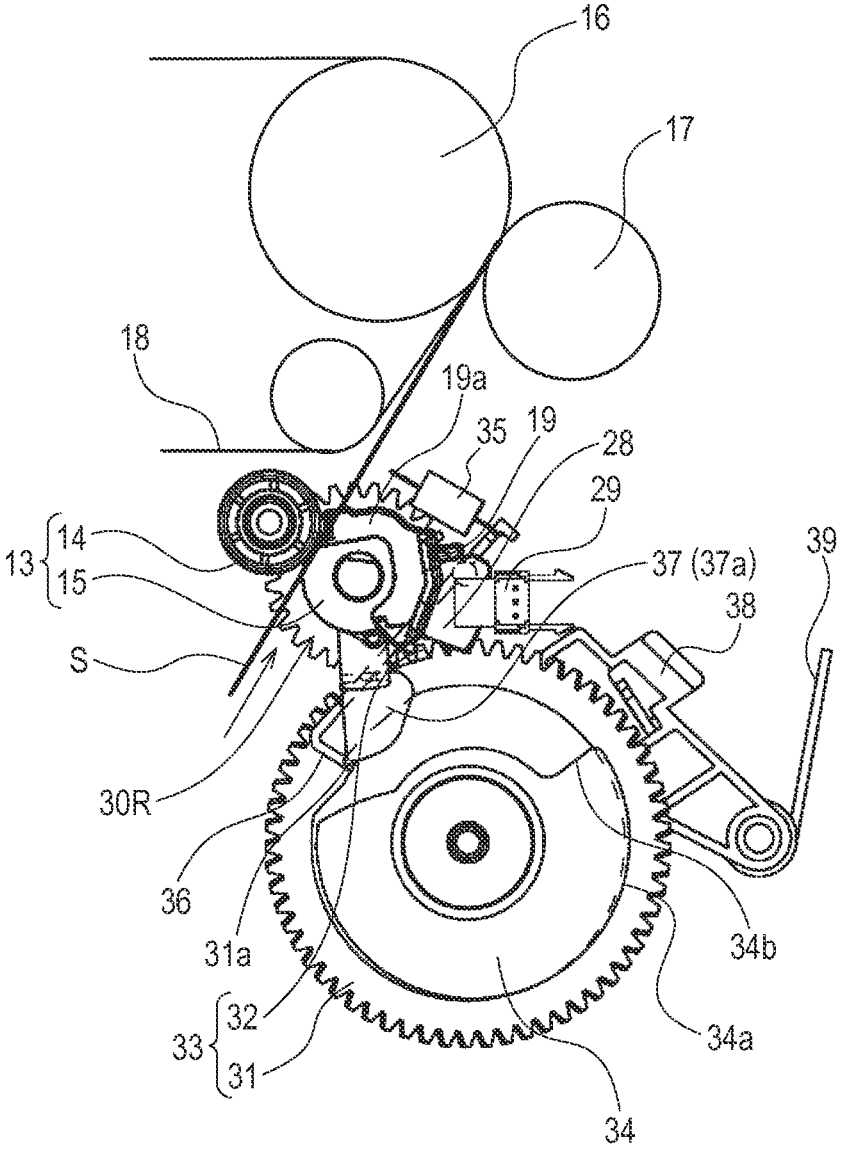

Then, when the trailing edge of the sheet S has passed through the nip portion of the conveying roller pair 13, the shutter members 19*a* to 19*d* (shutter connection member 19) supported in slidable contact with the sheet S pivot in the counter-clockwise direction of FIG. 9B due to the urging force of the torsion coil spring 27 so as to be restored to the initial positions illustrated in FIG. 6.

As described above, in the embodiment, because the double partially-toothless gear 33 is used for the shutter retracting mechanism 56, the following effects can be obtained. That is, in the embodiment, the first partially-toothless gear 31 is configured to rotate integrally with the second partially-toothless gear 32 by means of the abutment portion disposed therein after rotating by a predetermined angle determined with respect to the second partially-toothless gear 32. Accordingly, there is required only a weak force sufficient for releasing the hook portion 36*a* from the claw portion 31*a* of the first partially-toothless gear 31 in the light load state in which the load of the second partially-toothless gear 32, which is retained at the initial position by the urging lever 38, is not applied thereto. Therefore, by using a force slightly pressing the shutter members 19*a* to 19*d* by the leading edge of the sheet S which is being conveyed, the actuation lever 37 is pivoted in the releasing direction, and the latching arm 36 is slightly pivoted in the releasing direction by the abutment portion 37*c*, so that the first partially-toothless gear 31 is released to start rotating. Following the start of rotating, the second partially-toothless gear 32 is started to rotate, the rib 32*a* is moved away from the urging lever 38, and the actuation cam 34 is rotated, then, a series of operations can be proceeded.

As described above, the shutter retracting mechanism 56 includes the latching arm (latching member) 36 and the gear (driving gear) 30R. The latching arm 36 is configured to pivot in association with the actuation lever 37 in order to latch and unlatch the actuation cam 34. The gear 30R is configured to transmit a drive force from the drive source (now shown) which drives the conveying roller pair (second conveying rotary member) 13 to the actuation cam (cam member) 34. The shutter retracing mechanism 56 retains the shutter members 19*a* to 19*d* at the retracted positions and releases the same by using such operations of the latching arm 36 and the gear 30R, and hence relatively simple mechanism can be provided and cost reduction can be expected.

In the embodiment, without modifying the conventional image forming operations, the shutter members 19*a* to 19*d* can be retracted outside the conveying path of the sheet S (sheet conveying path) until the sheet S is nipped by the nip portion of the transfer portion 57 after passing through the conveying roller pair 13. With this, even for an extremely thin sheet or a sheet of low stiffness having basis weight of less than 60 g/m$^2$ at the place of the conveying roller pair 13, when the sheet S is nipped by the transfer portion 57, any damages to be generated on the sheet S, such as corrugation, can be surely prevented. As described above, regardless of the thickness of the sheet S to be conveyed, the capability of satisfactorily conveying the sheet S can be ensured.

Note that, although the embodiment is an example of applying the present invention to the color laser beam printer 53, the present invention is not limited thereto. Even when the present invention is applied to a monochrome printer, it is certain that the same effects can be obtained.

Second Embodiment

Figure 14:
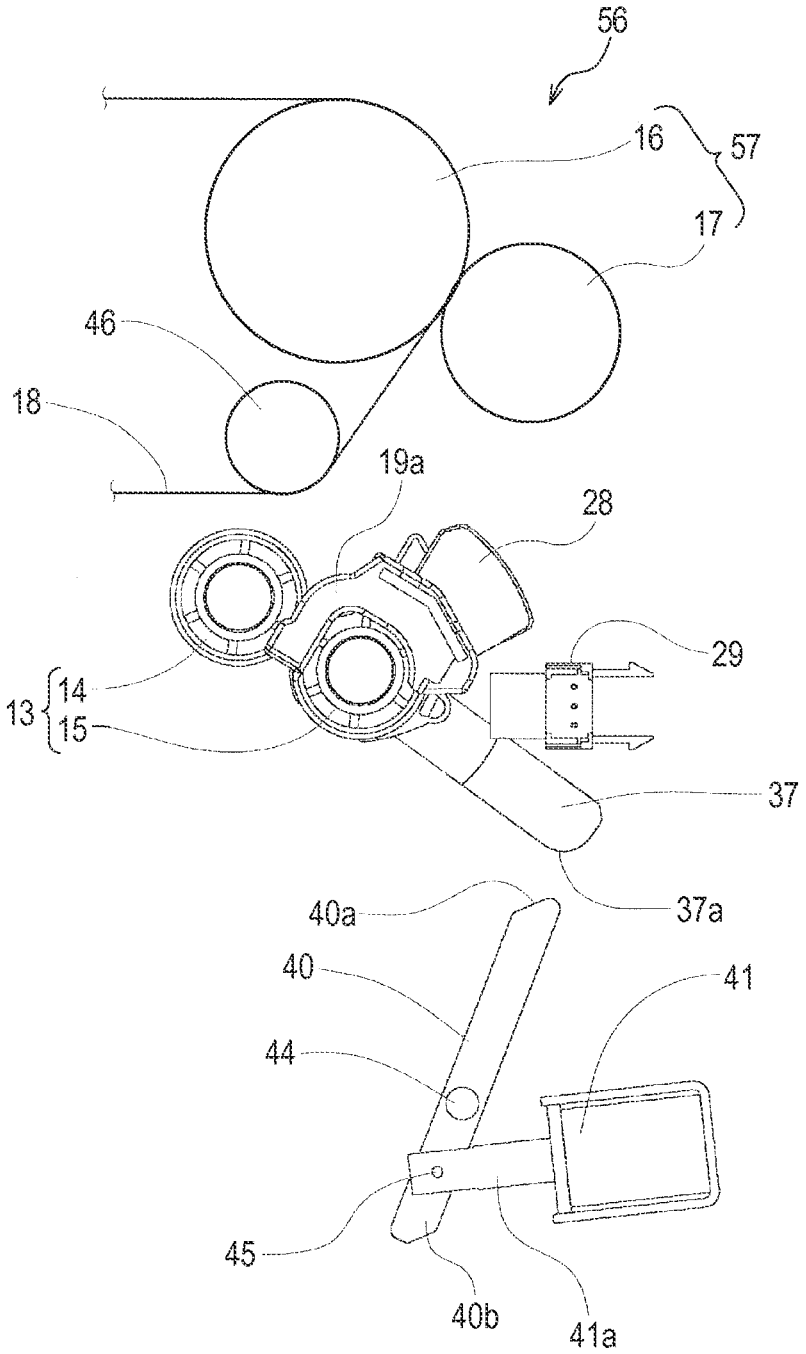
FIG. 14 is a cross-sectional view illustrating a shutter retracting mechanism of a second embodiment.
Figure 15:
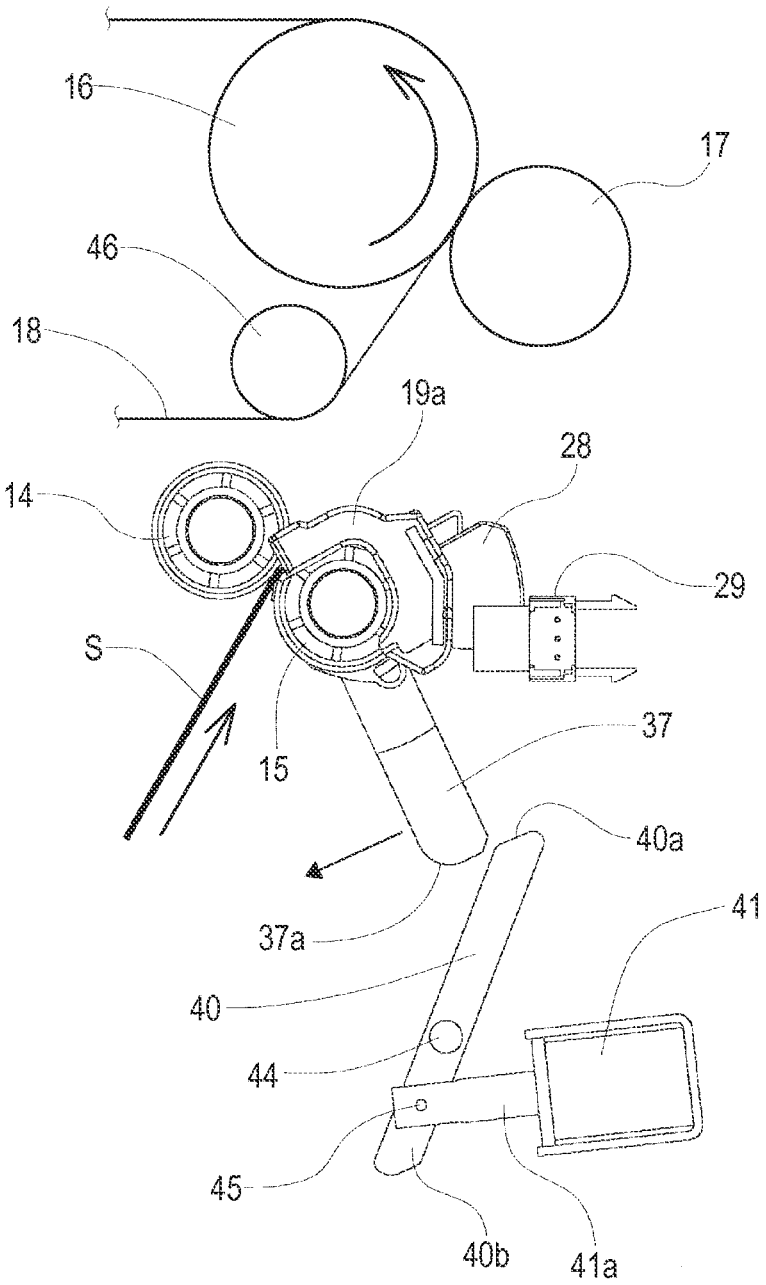
FIG. 15 is a cross-sectional view illustrating the shutter retracting mechanism of the second embodiment.
Figure 16:
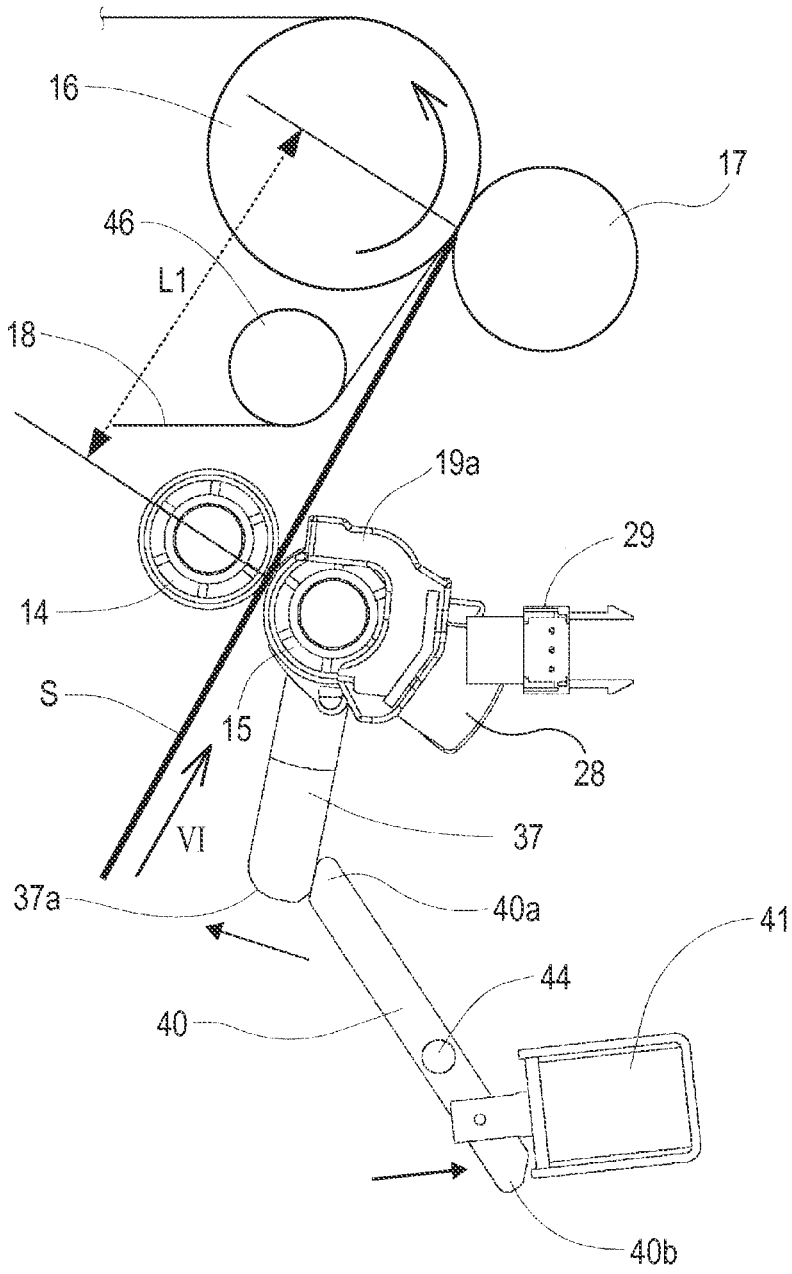
FIG. 16 is a cross-sectional view illustrating the shutter retracting mechanism of the second embodiment.

Next, a second embodiment of the sheet conveying apparatus 55 and the laser beam printer 53 will be described with reference to FIGS. 14 to 16. FIGS. 14 to 16 are cross-sectional views illustrating the shutter retracting mechanism 56 of the second embodiment. Only the configurations of the second embodiment different from those of the above-mentioned embodiment will be described, and the remaining configurations thereof will not be described. In the drawings, the portions common to those of the above-mentioned embodiment are designated by the same reference numerals.

The shutter retracting mechanism 56 of the second embodiment retains the shutter members 19*a* to 19*d* at the retracted positions by the operation of a solenoid 41.

Specifically, the shutter retracting mechanism 56 includes the actuation lever (actuation member) 37 which pivots integrally with the shutter members 19*a* to 19*d*. Moreover, the shutter retracting mechanism 56 includes a pivoting lever member 40 and the solenoid (drive portion) 41 which causes the pivoting lever member 40 to pivot. The pivoting lever member 40 abuts against the back surface of the actuation lever 37 when the shutter members 19*a* to 19*d* are located at the retracted positions so as to retain the actuation lever 37.

That is, in the second embodiment, because the double partially-toothless gear 33, the actuation cam 34, and the latching arm 36 are not used, the actuation lever 37 thereof is different from the actuation lever 37 in the first embodiment which includes the lever portion 37*a*. The actuation lever 37 of the second embodiment is configured to have a shape in which an upper end portion thereof is connected to the bearing portion 19R of the shutter connection member 19 so as to pivot integrally with the shutter connection member 19, and the lever portion 37*a* extends downward.

FIG. 14 illustrates a state of the initial position at which the shutter members 19*a* to 19*d* are opposed to the sheet leading edge. In FIGS. 15 and 16 in addition to FIG. 14, for the sake of illustrating, among the shutter members 19*a* to 19*d* disposed in the longitudinal direction of the shutter connection member 19, only the shutter member 19*a* is illustrated in the drawing.

As illustrated in FIG. 14, the pivoting lever member 40 is pivotably supported via a shaft 44 at a predetermined position of the feed frame 23R (refer to FIG. 2). The solenoid 41 including a plunger 41*a* which can move in and out of a solenoid main body is supported on the feed frame 23R. The distal end of the plunger 41*a* is pivotably connected to a lower end portion 40*b* of the pivoting lever member 40 via a pin 45. The pivoting lever member 40 is located at a position at which the upper end portion 40*a* thereof is opposed to the lever portion 37*a* of the actuation lever 37. The lever portion 37*a* is formed to have an arc shape at its front side when rotating in the clockwise direction in FIG. 14, and a liner shape at its rear side (back side) so as to be able to suitably abut against the upper end portion 40*a* having an oblique shape. The portion between the arc-shaped portion and the linear portion is slightly cut out.

FIG. 15 illustrates a state in which the leading edge of the sheet abuts against the shutter members 19*a* to 19*d*. When the leading edge of the sheet S, which has been conveyed by the feed roller 11 (refer to FIG. 1), abuts against the shutter members 19*a* to 19*d* so that the leading edge of the sheet S becomes parallel to the conveying roller pair 13, the force generated by the stiffness of the sheet S pushes and opens the shutter connection member 19 by overcoming the urging force. With this, the sheet S passes through the nip portion of the conveying roller pair 13 after its skew feed has been corrected.

At the same time, the actuation lever 37 pivots to a position at which the actuation lever 37 can abut against the upper end portion 40*a* of the pivoting lever member 40, and the sensor flag 28 also pivots by the same angle of that of the shutter connection member 19. As a result, the sensor flag 28 blocks the optical path of the photo-interrupter 29 so that the control portion 54 (refer to FIG. 1) installed in the laser beam printer 53 starts a series of image forming operations based on the information of the photo-interrupter 29.

Next, as illustrated in FIG. 16, the control portion 54 brings the plunger 41*a* of the solenoid 41 back into the solenoid main body at the timing when the sheet leading edge reaches the nip portion of the transfer portion including the transfer opposing roller 16 and the transfer roller 17. As a result, the pivoting lever member 40 pivots in the counter-clockwise direction in FIG. 15 so as to bring its upper end portion 40*a* into abutment with the lever portion 37*a* of the actuation lever 37 from behind and retain the same at the position. Therefore, the shutter connection member 19, which has been pivoted together with the actuation lever 37 in the same direction, is retained at the retracted position at which the shutter members 19*a* to 19*d* are retracted from the conveying path of the sheet S (sheet conveying path).

The above-mentioned pivoting timing of the pivoting lever member 40 is suitably calculated based on the information including the distance L1 between the nip portion of the conveying roller pair 13 and the nip portion of the transfer portion 57, and the conveying speed V1 of the sheet S, after the sensor flag 28 blocks the optical path of the photo-interrupter 29.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-095657, filed Apr. 22, 2011, which is hereby incorporated by reference herein in its entirety.

What is claimed is:

1. A sheet conveying apparatus, comprising:

a first conveying portion which conveys a sheet;

a second conveying portion, disposed downstream of the first conveying portion in a sheet conveying direction, having a nip portion that nips and conveys a sheet;

a third conveying portion, disposed downstream of the second conveying portion, which nips and conveys a sheet;

a shutter portion against which a leading edge of the sheet being conveyed abuts downstream of the first conveying portion and upstream of the nip portion of the second conveying portion, an urging portion configured to urge the shutter portion to a position at which the shutter portion abuts against the leading edge of sheet being conveyed, wherein the shutter portion is pressed and moved by the sheet being conveyed, against an urging force of the urging portion; and an actuation portion which moves the shutter portion that has been pressed and moved by the sheet being conveyed to a retracted position at which the shutter portion is retracted from a sheet conveying path and holds the shutter portion at the retracted position until the leading edge of the sheet being conveyed by the second conveying portion is nipped by the third conveying portion.

2. A sheet conveying apparatus according to claim 1, further comprising:

a drive source which drives the second conveying portion and the actuation portion;

a transmission mechanism which transmits a drive force from the drive source to the actuation portion so that the actuation portion holds the shutter portion at the retracted position, in association with a movement of the shutter portion pressed by the sheet being conveyed.

3. A sheet conveying apparatus according to claim 1, wherein, when the leading edge of the sheet is nipped by the third conveying portion, the actuation portion releases a retention of the shutter portion at the retracted position so that the shutter portion becomes restorable toward an initial position at which the leading edge of the sheet being conveyed abuts against the shutter portion.

4. A sheet conveying apparatus according to claim 2, wherein the actuation portion comprises a rotatable cam member including a permissible cam face and a retention cam face, the permissible cam face permitting a movement of the shutter portion from an initial position, at which the leading edge of the sheet being conveyed abuts against the shutter portion, to the retracted position, the retention cam face abutting against an abutment portion of the shutter portion so as to retain the shutter portion at the retracted position, and wherein the transmission mechanism transmits a rotary drive force from the drive source so that the rotatable cam member rotates.

5. A sheet conveying apparatus according to claim 4, wherein the transmission mechanism comprises:

a latching member movable in association with the shutter, the latching member performing a latching for stopping a rotation of the rotatable cam member and a release of the latching; and a driving gear which transmits the drive force from the drive source to the rotatable cam member, and wherein the latching member and the driving gear operate to perform the retention of the shutter portion at the retracted position and a release of the retention of the shutter portion.

6. A sheet conveying apparatus according to claim 5, wherein the transmission mechanism comprises a transmission gear having a toothless portion, the transmission gear transmitting the drive force, which is transmitted from the drive source to the driving gear, to the rotatable cam member by meshing with the driving gear, wherein the latching member latches the transmission gear at a position at which the toothless portion is opposed to the driving gear, and wherein the transmission gear transmits the drive force, which is transmitted from the drive source to the driving gear, to the rotatable cam member when the latching member moves in association with the shutter portion, which is pressed and moved by the sheet, so as to release the latching, thereby bringing the rotatable cam member into abutment against the shutter portion so as to retain the shutter portion.

7. An image forming apparatus, comprising:

a first conveying portion which conveys a sheet;

a second conveying portion, disposed downstream of the first conveying portion in a sheet conveying direction, having a nip portion that nips and conveys a sheet;

an image transfer portion which transfers a toner image to a sheet at a transfer nip portion disposed downstream of the second conveying portion in the sheet conveying direction;

a fixing portion which fixes, to the sheet, the toner image transferred to the sheet by the image transfer portion;

a shutter portion against which a leading edge of the sheet being conveyed abuts downstream of the first conveying portion and upstream of the nip portion of the second conveying portion;

an urging portion configured to urge the shutter portion to a position at which the shutter portion abuts against the leading edge of sheet being conveyed, wherein the shutter portion is pressed and moved by the sheet being conveyed, against an urging force of the urging portion; and an actuation portion which moves the shutter portion that has been pressed and moved by the sheet being conveyed to a retracted position at which the shutter portion is retracted from a sheet conveying path and holds the shutter portion at the retracted position until the leading edge of the sheet being conveyed by the second conveying portion is nipped by the transfer nip portion.

8. An image forming apparatus according to claim 7, further comprising;

a drive source which drives the second conveying portion and the actuation portion;

a transmission mechanism which transmits a drive force from the drive source to the actuation portion so that the actuation portion holds the shutter portion at the retracted position, in association with a movement of the shutter portion pressed by the sheet being conveyed.

9. An image forming apparatus according to claim 7, wherein, when the leading edge of the sheet is nipped by the transfer nip portion, the actuation portion releases a retention of the shutter portion at the retracted position so that the shutter portion becomes restorable toward an initial position at which the leading edge of the sheet being conveyed abuts against the shutter portion.

10. An image forming apparatus according to claim 9, wherein the actuation portion comprises a rotatable cam member including a permissible cam face and a retention cam face, the permissible cam face permitting a movement of the shutter portion from an initial position, at which the leading edge of the sheet being conveyed abuts against the shutter portion, to the retracted position, the retention cam face abutting against an abutment portion of the shutter portion so as to retain the shutter portion at the retracted position, and wherein the transmission mechanism transmits a rotary drive force from the drive source so that the rotatable cam member rotates.

11. An image forming apparatus according to claim 10, wherein the transmission mechanism comprises:

a latching member movable in association with the shutter portion, the latching member performing a latching for stopping a rotation of the rotatable cam member and a release of the latching; and a driving gear which transmits the drive force from the drive source to the rotatable cam member, and wherein the latching member and the driving gear operate to perform the retention of the shutter portion at the retracted position and a release of the retention of the shutter portion.

12. An image forming apparatus according to claim 11, wherein the transmission mechanism comprises a transmission gear having a toothless portion, the transmission gear transmitting the drive force, which is transmitted from the drive source to the driving gear, to the rotatable cam member by meshing with the driving gear, wherein the latching member latches the transmission gear at a position at which the toothless portion is opposed to the driving gear, and wherein the transmission gear transmits the drive force, which is transmitted from the drive source to the driving gear, to the rotatable cam member when the latching member moves in association with the shutter portion, which is pressed and moved by the sheet, so as to release the latching, thereby bringing the rotatable cam member into abutment against the shutter portion so as to retain the shutter portion.

* * * * *